US005456736A

United States Patent [19]

Waki et al.

[11] Patent Number: 5,456,736

[45] Date of Patent: Oct. 10, 1995

[54] LAP AND LAPPING LIQUOR

[75] Inventors: Yoshiharu Waki, Chigasaki; Masayasu Fujisawa, Kanagawa; Shigeo Aikawa, Yokohama; Kenya Ohashi, Hitachi; Yukihiro Isono, Odawara, all of Japan

[73] Assignee: Hitachi, Ltd., Tokyo, Japan

[21] Appl. No.: 26,576

[22] Filed: Mar. 5, 1993

[30] Foreign Application Priority Data

Apr. 6, 1992 [JP] Japan ..... 4-084061

[51] Int. Cl.[6] ..... C09K 1/68

[52] U.S. Cl. ..... 51/309; 29/603; 106/3; 451/548; 451/550; 451/905; 216/88

[58] Field of Search ..... 51/309, DIG. 6, 51/209 DL, 209 R; 106/3; 156/636; 360/122; 29/603; 451/905, 548, 550

[56] References Cited

U.S. PATENT DOCUMENTS

| | | | |
|---|---|---|---|
| 4,010,583 | 3/1977 | Highberg | 51/284 |
| 4,762,534 | 8/1988 | Ito et al. | 51/293 |
| 4,842,618 | 6/1989 | Ito et al. | 51/293 |
| 4,980,995 | 1/1991 | Smith | 51/283 R |
| 5,028,242 | 7/1991 | Ito et al. | 51/295 |
| 5,083,365 | 1/1992 | Matsumoto | 29/603 |

FOREIGN PATENT DOCUMENTS

| | | |
|---|---|---|
| 59-196160 | 11/1984 | Japan . |
| 60-135173 | 7/1985 | Japan . |

OTHER PUBLICATIONS

Foundation of Interfacial Phenomena, p. 94, lines 9–19 (published by Asakura Shoten, 1973).

*Primary Examiner*—Deborah Jones
*Attorney, Agent, or Firm*—Antonelli, Terry, Stout & Kraus

[57] ABSTRACT

This invention provides a lap capable of reducing the pole recession produced between the substrate and the magnetic film when the air-bearing surface of a thin-film magnetic head is lapped, a lapping liquor used for such lapping, and a thin-film magnetic head having its air-bearing surface lapped by using them. Lapping is carried out by using a lap made of a material having both a phase of tin and a phase of brass with a greater rigidity in supporting the abrasive grains than tin, and a lapping liquor prepared by mixing an anionic surfactant (15) and an ampholytic surfactant (16). According to the present invention, it is possible to reduce the pole recession in the thin-film magnetic heads and to accordingly shorten the recording bit length of the magnetic discs.

7 Claims, 14 Drawing Sheets

POLE RECESSIONS PRODUCED AFTER LAPPING WITH VARIOUS TYPES OF LAPPING LIQUOR (FIG. 16)

LAP AND LAPPING LIQUOR

BACKGROUND OF THE INVENTION

This invention relates to a thin-film magnetic head which is smaller than the conventional products in pole recession created in the magnetic film portion when the air-bearing surface is lapped. The invention also relates to a lap, a lapping liquor and a lapping method applicable to lapping of various types of products comprising composite material, which include not only the thin-film magnetic heads but also other articles having the portions differing in hardness or having a portion positively charged in the surface and a portion negatively charged in the surface when placed in an aqueous solution.

As discussed on page 28 of "Essentials of Working Techniques for Magnetic Heads" by Japan Industrial Technology Research Center (1985), cast iron, tin, stone, kemets and the like have been used for lapping of the magnetic heads. Especially for lapping of the air-bearing surface of the thin-film magnetic heads, tin has been popularly used as lap material.

Also, as mentioned on page 94 of "Foundation of Interfacial Phenomena" published by Asakura Shoten (1973), an anionic surfactant (sulfate of naphthalene condensate) has been generally used for preparing a lapping liquor having a non-polar powder such as diamond powder dispersed therein.

Lapping of the air-bearing surface of a thin-film magnetic head by use of a conventional lap such as mentioned above (especially one made of tin) had the problem that a pole recession 22 such as shown in FIG. 25 of the accompanying drawings is produced in the lapped air-bearing surface due to difference in hardness among substrate 13, protective film 12 and magnetic film 11 of the thin-film magnetic head.

Generation of said pole recession is ascribed to the variance in depth of indentation of the abrasive grains, which is caused due to difference in working efficiency for the different materials composing the magnetic head, said materials differing in hardness from each other, when the surfaces of said materials are subjected to finish lapping under a same lapping pressure. For example, in manufacture of a conventional thin-film magnetic head comprising a magnetic film having a Vickers hardness of about 200 kgf/mm and a protective film and a substrate both having a Vickers hardness of 1,300 kgf/mm or greater, there would be produced a pole recession of about 0.03 μm at most in the magnetic film portion due to difference in hardness among said magnetic film, protective film and substrate.

It is known that when lapping is conducted on the air-bearing surface of a thin-film magnetic head by using a conventional lapping liquor such as mentioned above, an adsorption film may be formed on the protective film 12 (usually made of alumina) or on the magnetic film 11 and substrate 13 composing the magnetic head. (Whether such an adsorption film is formed or not depends,on the type (polarity) of the electric charges on the surface of the magnetic film 11, etc., and the type of the surfactant (either anionic or cationic) used in the lapping liquor). As a result of close investigation of the action of the adsorption film, the present inventors found that the portion where such adsorption film exists is harder to lap than other portion, and this is responsible for generation of pole recession 22 such as shown in FIG. 25. For example, when lapping is carried out by using a lapping liquor prepared by dispersing 0.6 g of diamond grains with an average grain size of 0.25 μm in 500 ml of a 1.0 wt % aqueous solution of sodiumalkyldiphenyl ether disulfonate, there is produced a pole recession of about 0.03 μm at smallest.

The presence of such a pole recession poses the problem that it becomes substantially impossible to reduce by such amount the flying height (indicated by 20 in FIG. 25) of the magnetic head, making it unable to reduce the recording wavelength as desired. There is a certain relationship between flying height of the magnetic head and recording wavelength. For instance, in the example shown in FIG. 26, when the flying height increases by 0.01 μm, the bit length is accordingly increased by 0.03 μm. Therefore, in the example shown in FIG. 26, when there exists a pole recession of 0.03 μm in the air-bearing surface of the magnetic head, the bit length becomes 0.15 μm longer than when no such pole recession exists, resulting in a corresponding decrease of recording density.

SUMMARY OF THE INVENTION

An object of the present invention, therefore, is to provide a thin-film magnetic head which is minimized in pole recession in its lapped surface to substantially enable a desired reduction of flying height, a process for producing such a magnetic head, and the magnetic disc devices using said magnetic head.

Another object of the present invention is to provide a lapping method for various types of products made of composite materials, including those having the portions different in hardness or having a portion positively charged and a portion negatively charged, both in the surface, when placed in an aqueous solution, a lapping liquor, a lap and a lapping device using them.

of the air-bearing surface of each of the magnetic heads lapped by said multiphase alloy laps.

Figure 14:
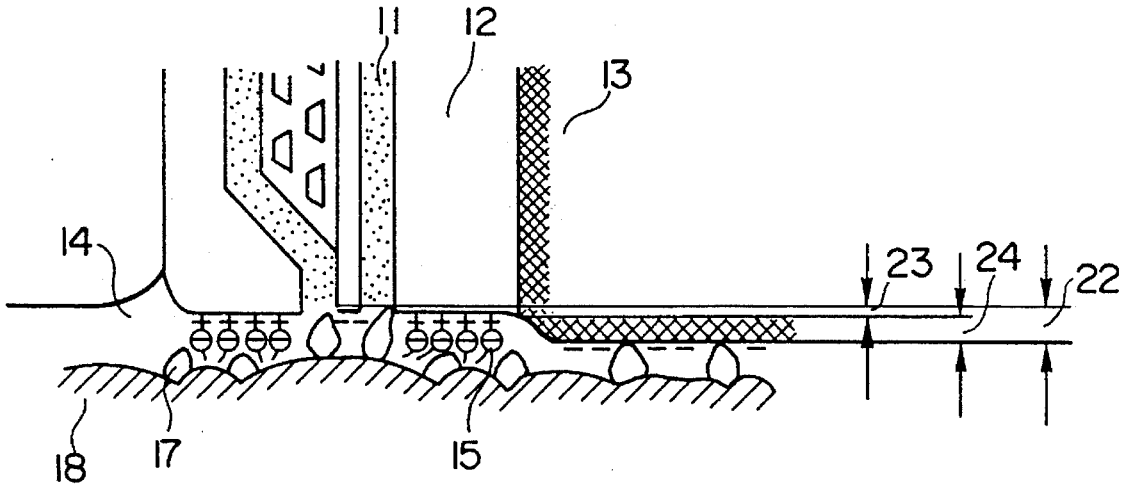

FIG. 14 is a schematic illustration showing a mode of lapping with a lapping liquor using an anionic surfactant.

Figure 15:
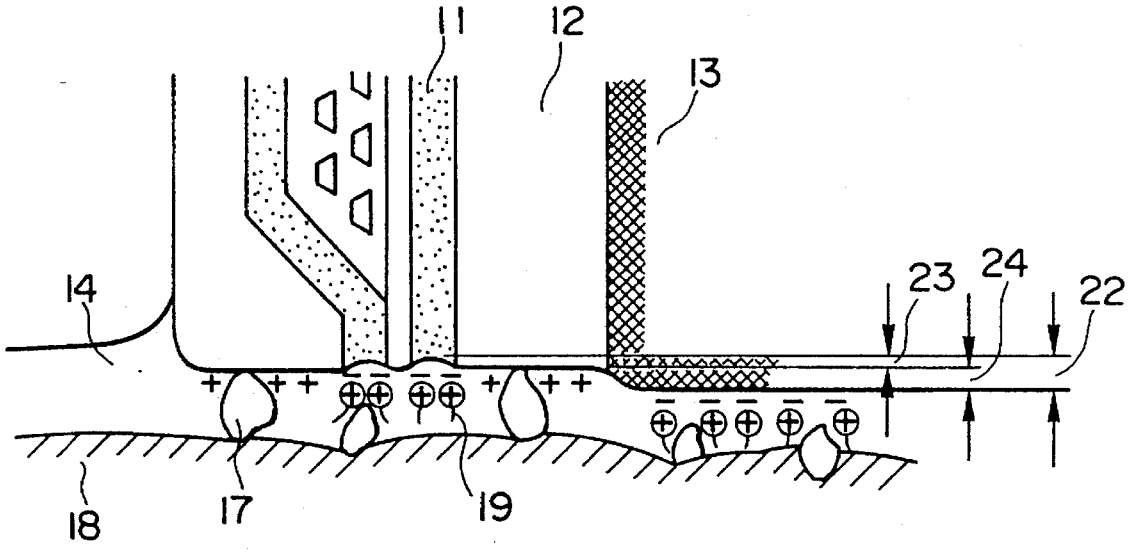

FIG. 15 is a schematic illustration showing a mode of lapping with a lapping liquor using a cationic surfactant.

Figure 16:
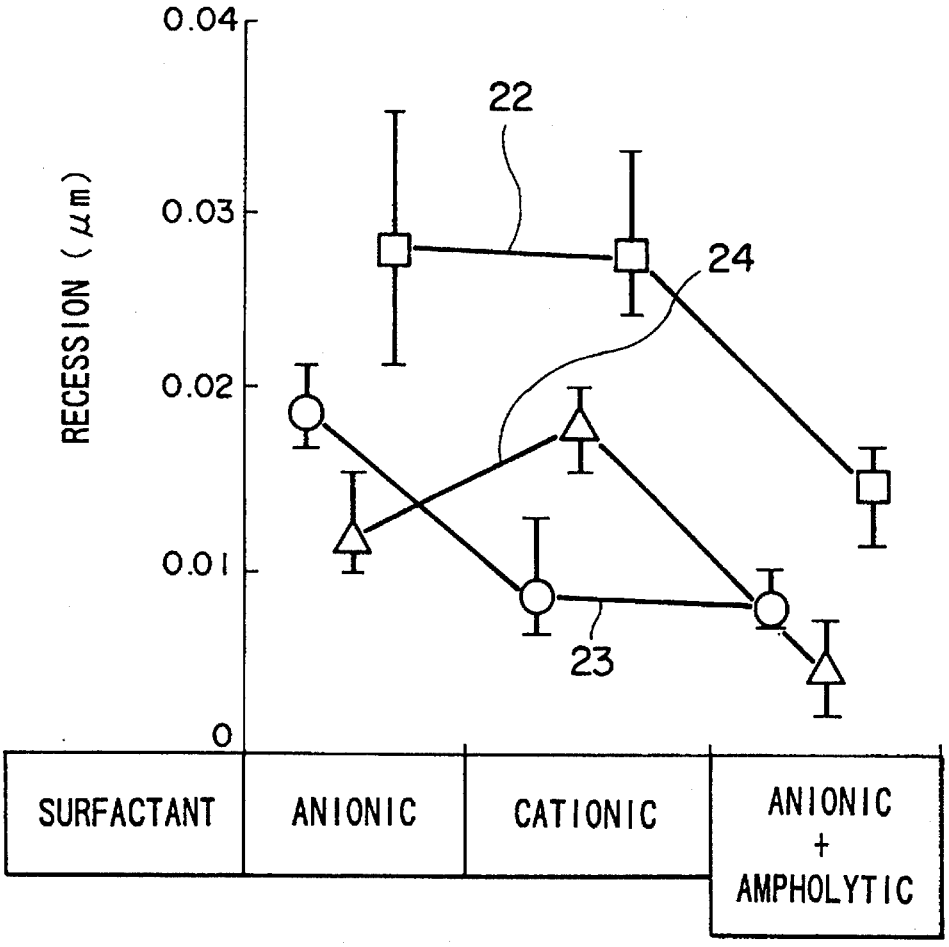

FIG. 16 is a graph showing the pole recessions generated when lapping was carried out by using various types of lapping liquor.

Figure 17:
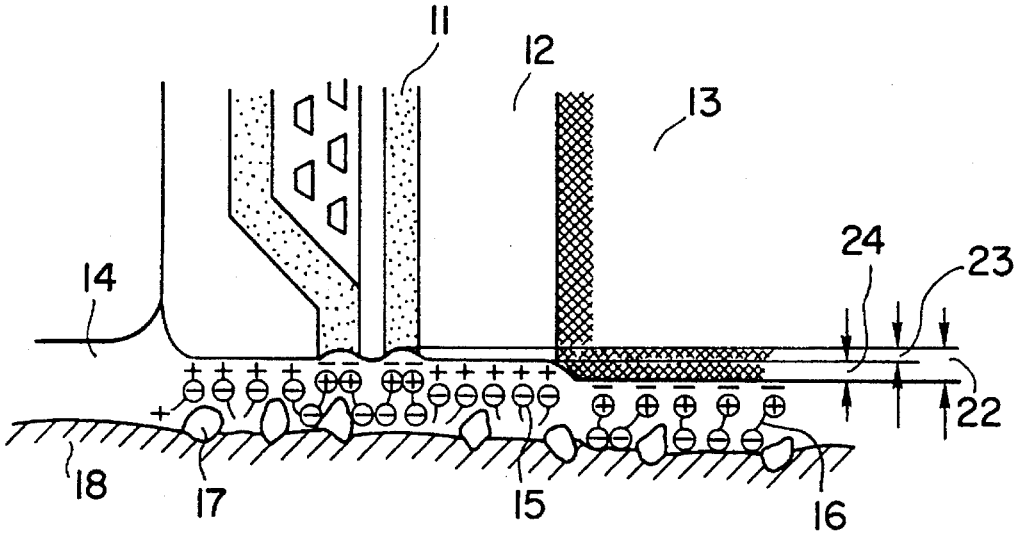

FIG. 17 is a schematic illustration showing a mode of lapping of a thin-film magnetic head by using a lapping liquor according to the present invention.

Figure 18:
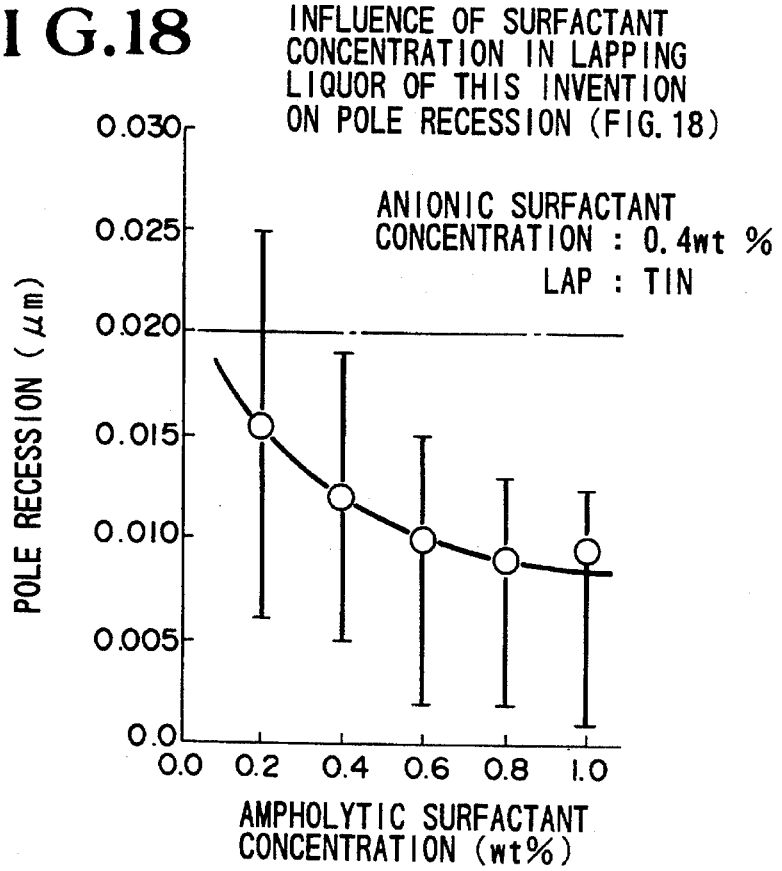

FIG. 18 is a graph showing the influence of surfactant concentration in a lapping liquor of this invention on pole recession.

Figure 19:
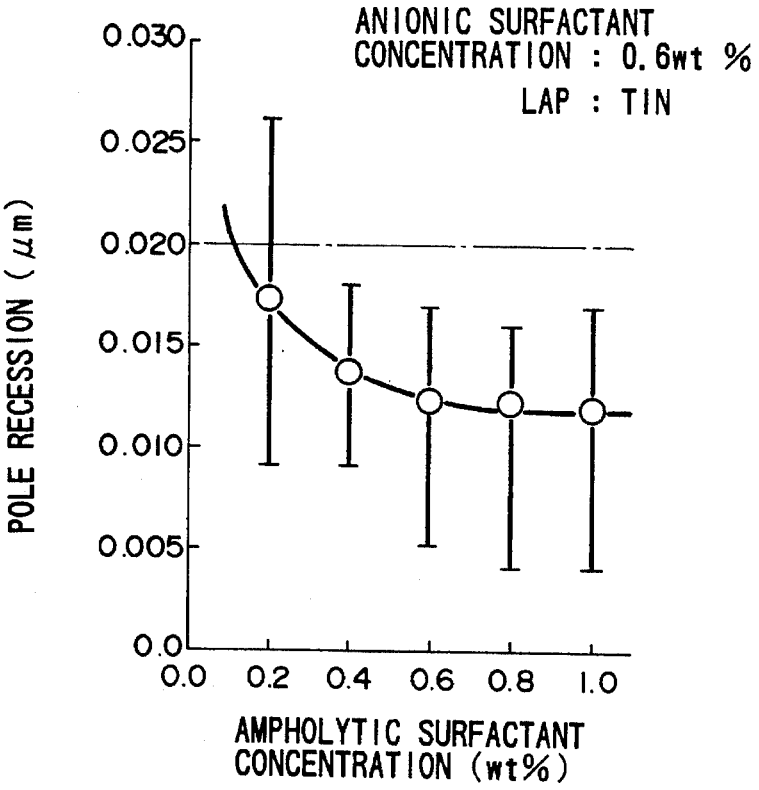

FIG. 19 is a graph showing the influence of surfactant concentration in a lapping liquor of this invention on pole recession.

Figure 20:
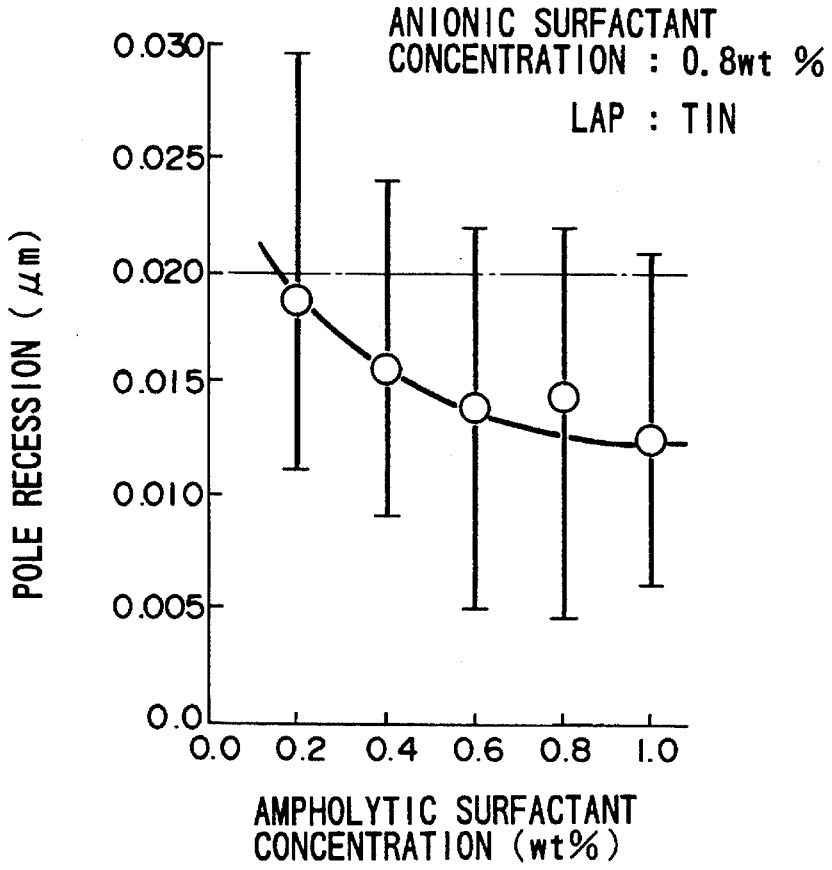

FIG. 20 is a graph showing the influence of surfactant concentration in a lapping liquor of this invention on pole recession.

Figure 21:
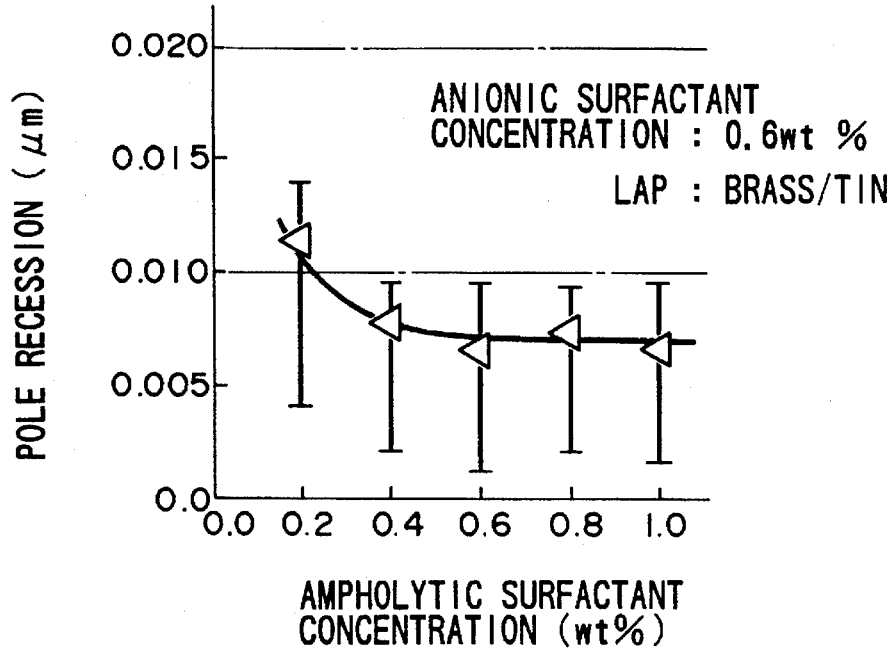

FIG. 21 is a graph showing the pole recession generated when lapping was carried out by using a lapping liquor and a brass-tin lap according to the present invention.

Figure 22:
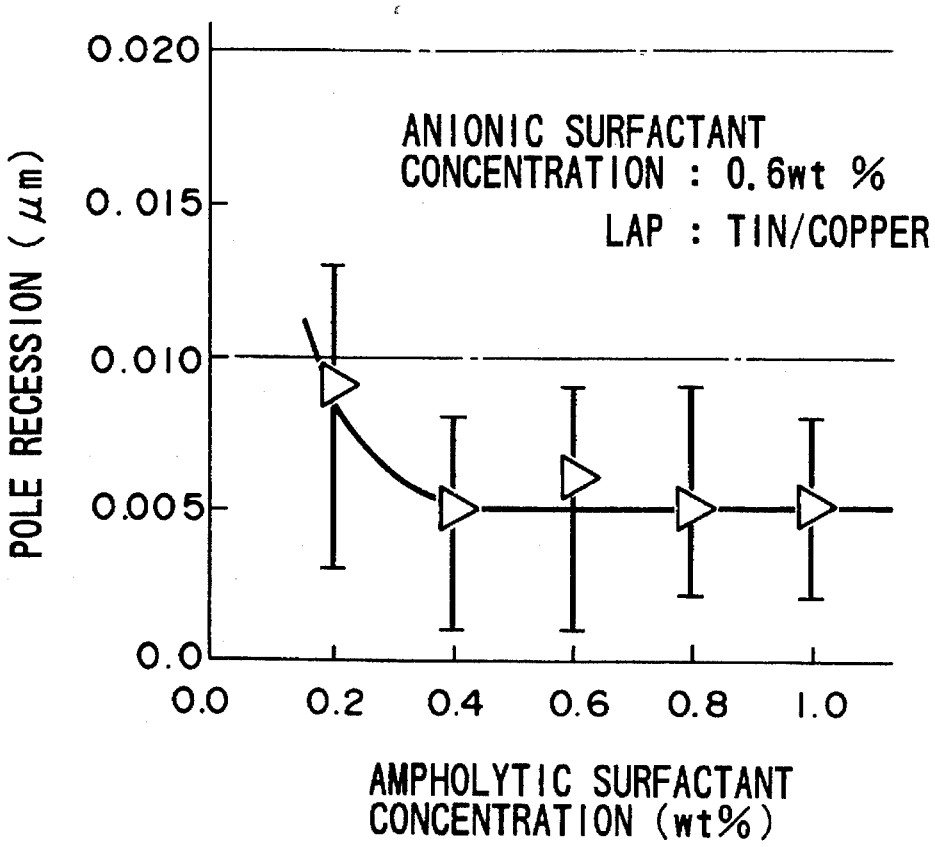

FIG. 22 is a graph showing the pole recession generated when lapping was carried out by using a lapping liquor and a tin-copper lap according to the present invention.

Figure 23:
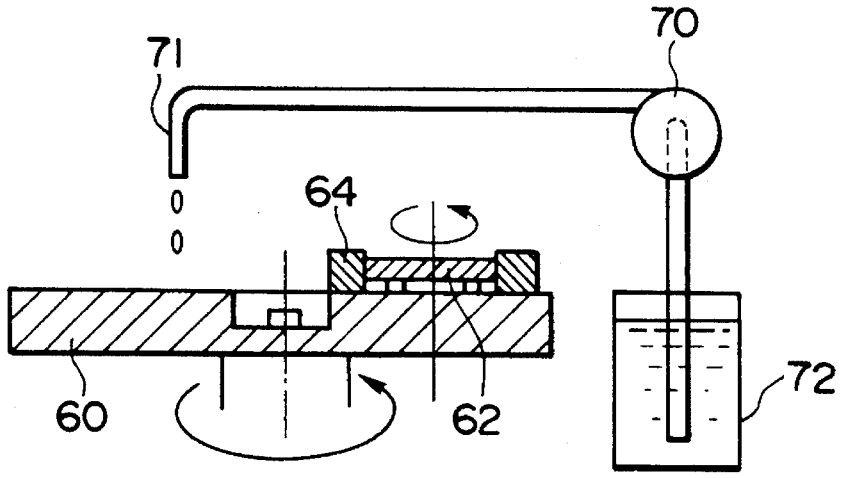

FIG. 23 is a schematic illustration of a lapping device using a lap according to the present invention.

Figure 24:
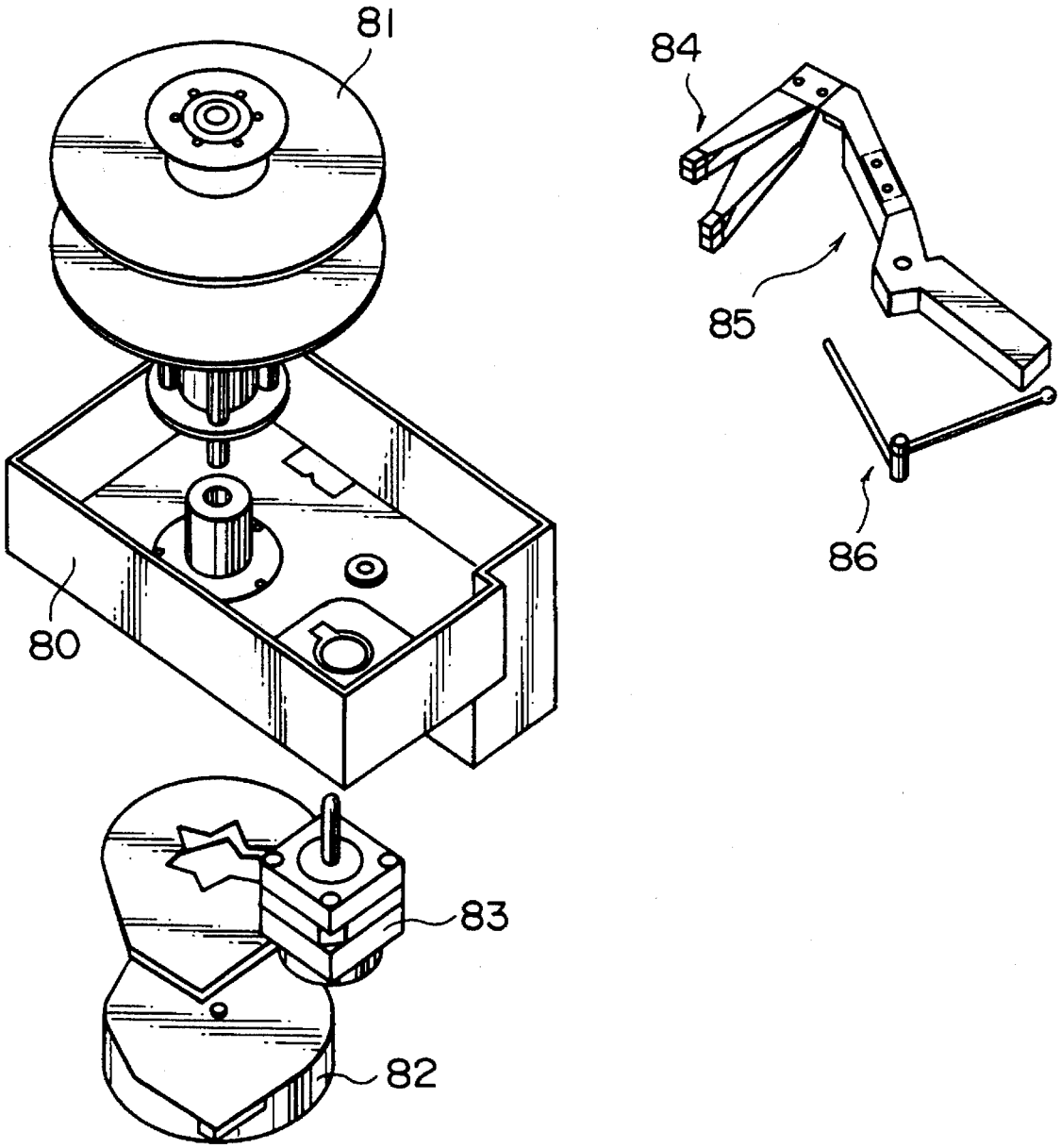

FIG. 24 is an exploded perspective view of a magnetic recording device having a magnetic head lapped by using a lap and a lapping liquor according to the present invention.

Figure 25:
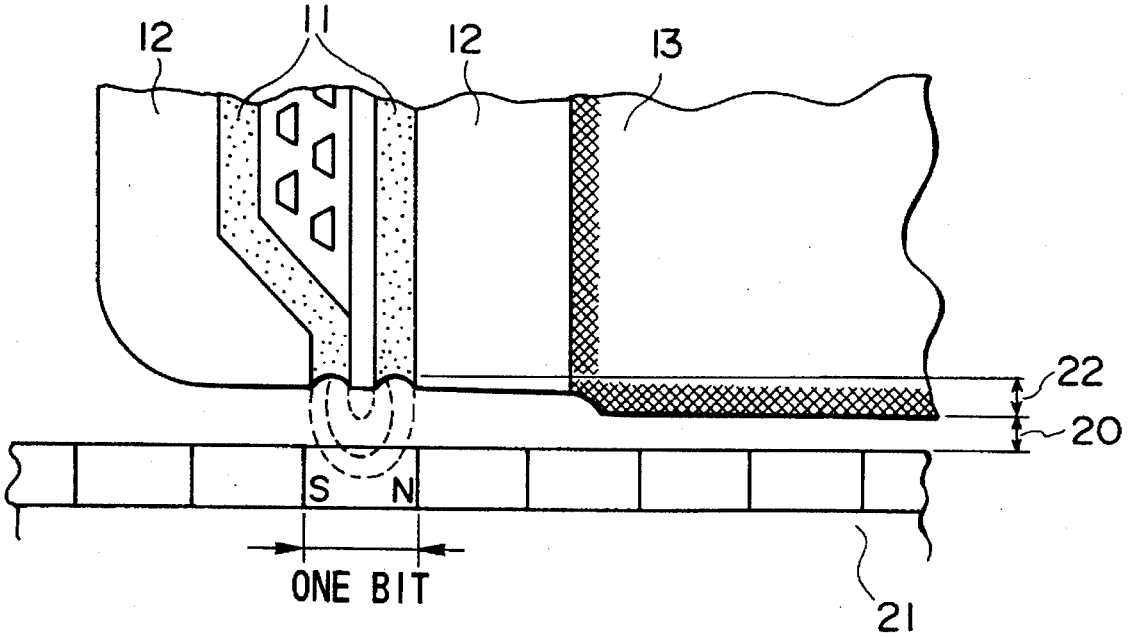

FIG. 25 is a schematic illustration of a magnetic head and a magnetic disc.

Figure 26:
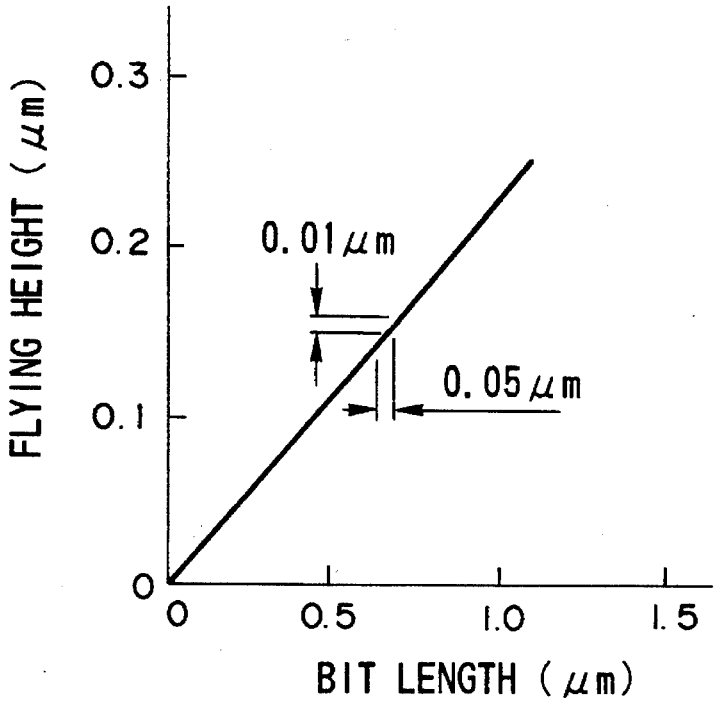

FIG. 26 is a graph showing the relationship between flying height of the magnetic head and recording bit length.

The reference numerals used in the drawings designate the following:

1: brass phase, 2: tin phase, 3: tin phase, 4: tin-copper compound phase, 5: thin-film magnetic head, 6: air-bearing surface, 11: magnetic film, 12: protective film, 13: substrate, 14: lapping liquor, 15: anionic surfactant, 16: ampholytic surfactant, 17: diamond grains, 18: lap, 19: cationic surfactant, 20: flying height, 21: magnetic disc, 22: pole recession, 23: level difference, 24: level difference, 31: diamond indenter, 32: voice coil, 33: differential transformer, 34: recorder, 35: fulcrum, 36: load, 37: depth of indentation, 60: lap, 62: jig, 64: correcting ring, 70: pump, 71: tube, 72: tank, 80: casing, 81: magnetic disc, 82: spindle motor, 83: stepper motor, 84: magnetic head, 85: swing arm, 86: steel band.

DETAILED DESCRIPTION OF THE INVENTION

In lapping of different types of materials differing in hardness, the working efficiency differs for the respective materials when the lapping force is same. On the other hand, lapping force and working efficiency are in a substantially proportional relation. However, in the case of a composite article made of different types of material, since the working efficiency in the stationary state must be equalized for the respective materials, there is produced a difference in lapping force among the materials. This causes generation of a difference in depth of bite of the abrasive grains into the object to be lapped, resultantly giving rise to a pole recession. When a material having a greater rigidity in supporting the abrasive grains than tin used for the conventional laps is selected as the lap and lapping is carried out by using this lap, the difference in depth of bite of the abrasive grains into the object to be lapped is reduced, resulting in a decreased pole recession.

Lapping with a material having a greater abrasive grain supporting rigidity than tin is bound to increase the surface roughness of the lapped object. However, by carrying out lapping with a lap made of a material having both the phase of a material with a large abrasive grain supporting rigidity and the phase of tin, it is possible to hold the lapped surface roughness to the same level as lapping with tin and to make the pole recession less than when carrying out lapping with tin.

An anionic surfactant is used in the conventional lapping liquors, so that in lapping of a composite article an adsorption film is formed on the material whose surface is positively charged but no adsorption film is formed on the material whose surface is negatively charged. Consequently, there is produced a large difference in lapping force acting to the abrasive grains between the different types of materials. This leads to creation of a large pole recession in the lapped surface. However, a lapping liquor prepared by mixing an anionic surfactant and an ampholytic surfactant is capable of forming an absorption film on not only the positively charged portion but also the negatively charged portion of a composite article, so that the difference in lapping force acting to the abrasive grains between the different types of materials is reduced, and consequently the pole recession becomes less than when lapping is conducted with a conventional lapping liquor.

In lapping of a composite article, since there is produced a difference in lapping force acting to the abrasive grains between the different types of materials, there is correspondingly produced a difference in the amount of vertical movement of the abrasive grains, giving rise to a pole recession in the lapped surface of the composite article. So, when lapping is carried out by using a lap made of a material having a large rigidity in supporting the abrasive grains, the difference in the amount of vertical movement of the abrasive grains is reduced, resulting in a corresponding dimunition of the pole recession.

Also, by conducting lapping with a material having both the phase of tin and the phase of a material with a large abrasive grain supporting rigidity,it is possible to obtain a same level of surface roughness as provided by lapping with tin, and also the pole recession can be made less than when lapping is carried out with tin.

When using a conventional lapping liquor in which an anionic surfactant is used, an adsorption film is formed on that material of the composite article whose surface is positively charged but no adsorption film is formed on the material whose surface is negatively charged, so that there is created a large difference in lapping force acting to the abrasive grains between the different materials, resulting in producing a large pole recession. However, in the case of a lapping liquor prepared by mixing an anionic surfactant and an ampholytic surfactant, an adsorption film is formed on the surface of the whole of the composite article, so that the difference in lapping force acting to the abrasive grains between the different types of material is reduced, and consequently the pole recession becomes less than when using a conventional lapping liquor.

Thus, lapping by use of said lap and lapping liquor according to this invention makes it possible to obtain a magnetic head small in pole recession. Use of such a magnetic head can provide a magnetic recording device capable of recording with higher density than possible with the conventional recorders.

DESCRIPTION OF PREFERRED EMBODIMENTS

Before describing the embodiments of the present invention, explanations are given on the underlying conceptions of the invention.

In lapping of a composite article, or an article composed of the different types of materials differing in hardness, the lapping efficiency differs between the materials since a constant lapping force is applied to the abrasive grains. Generally, lapping force and lapping efficiency are substantially proportional to each other, and there exist the following relations between them:

$$\Delta V_1/\Delta t=\alpha_1 \cdot P_1 \quad \text{formula 1}$$

$$\Delta V_2/\Delta t=\alpha_2 \cdot P_2 \quad \text{formula 2}$$

wherein $\Delta V_1$ ($mm^3$) and $\Delta V_2$ ($mm^3$) are the amounts of the materials lapped in a given period of time $\Delta t$ (s); $P_1$ (N) and $P_2$ (N) are the lapping forces acting to the abrasive grains involved in lapping of the respective materials; and $\alpha_1$ and $\alpha_2$ are the constants indicating the easiness of cutting of the materials, but $\alpha_1 \neq \alpha_2$.

When a pole recession of a certain degree is produced in each of the different types of materials, the lapping efficiencies for the respective materials are equalized, so that there is correspondingly produced a difference in lapping force between the materials. Thus, in relation to the above-shown formulae 1 and 2, there exist the relations such as represented by the following formulae 3 and 4:

$$\Delta V_1/\Delta t=\Delta V_2/\Delta t \quad \text{formula 3}$$

$$\alpha_1 \cdot P_1=\alpha_2 \cdot P_2 \quad \text{formula 4}$$

wherein $P_1 \neq P_2$ since $\alpha_1 \neq \alpha_2$.

This difference in lapping force gives rise to a corresponding difference in the amount of vertical movement of the abrasive grains during lapping, which is associated with the rigidity of the lap in supporting the abrasive grains, and this causes generation of a pole recession in the lapped surface of the composite article. The term "rigidity in supporting" used in the present specification indicates how the amount of plastic deformation induced when adding a load to the material varies according to the amount of said load.

The above concepts are explained more particularly below with relation to lapping of a thin-film magnetic head by referring to FIGS. 1 and 2 of the accompanying drawings.

The substrate 13 has a Vickers hardness Hv of approximately 1,300, and the protective film 12 has Hv of approximately 1,000 while the magnetic film has Hv of approximately 200. Thus, Hv of the magnetic film 11 is less by about one figure than that of the substrate. Therefore, the lapping force acting to the abrasive grains is low at the soft spot and high at the hard spot. This is because $P_1<P_2$ in the above formula 4 since $\alpha_1>\alpha_2$ when the material constant of the soft material is given as $\alpha_1$ and that of the hard material is given as $\alpha_2$. Naturally, the abrasive grains are indented not too much into the lap at the spot where the lapping force is small, but they are indented deep into the lap at the spot where the lapping force is large. Thus, the depth of indentation of the abrasive grains into the lap varies according to the hardness of the material to be lapped, and this gives rise to a pole recession.

When lapping is carried out by using a lap with high rigidity in supporting the abrasive grains, the difference in amount of vertical movement of the abrasive grains due to the difference in lapping force acting to the abrasive grains is reduced, which accordingly decreases the pole recession.

Figure 3:
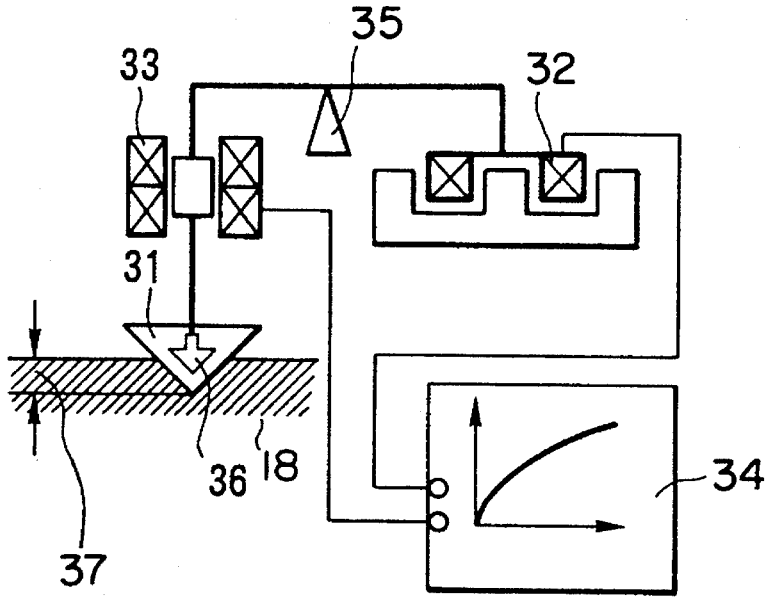
FIG. 3 is a block diagram of an indentation tester.
Figure 4:
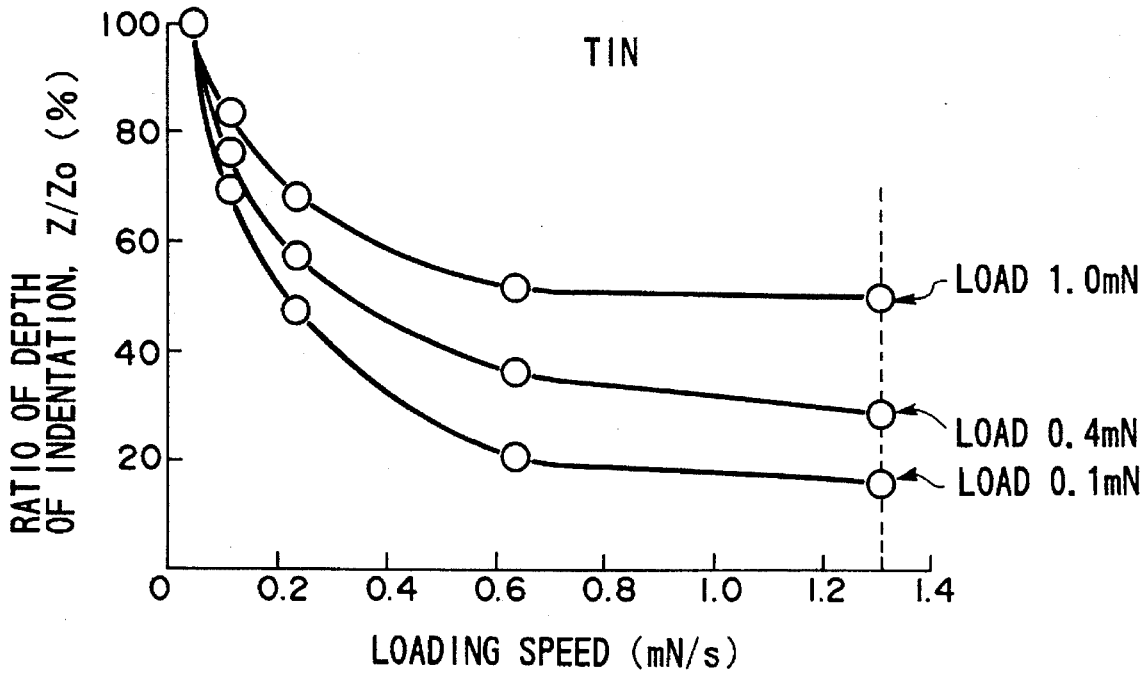
FIG. 4 is a characteristic diagram showing the results of indentation of an indenter into tin.
Figure 5:
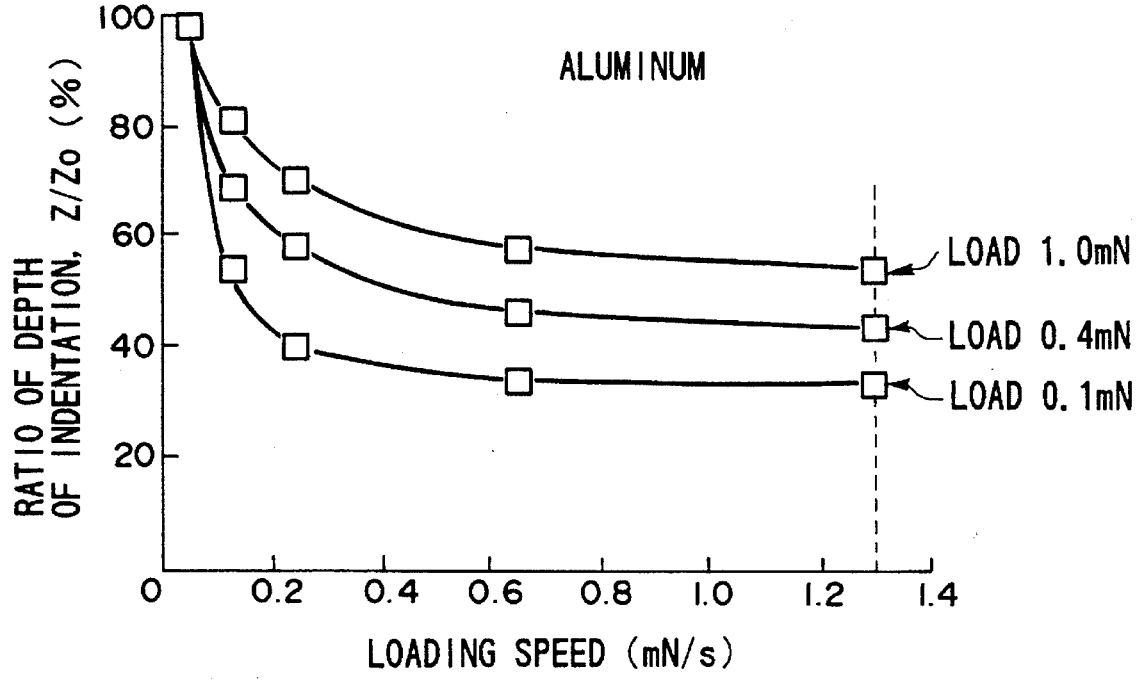
FIG. 5 is a characteristic diagram showing the results of indentation of an indenter into aluminum.
Figure 6:
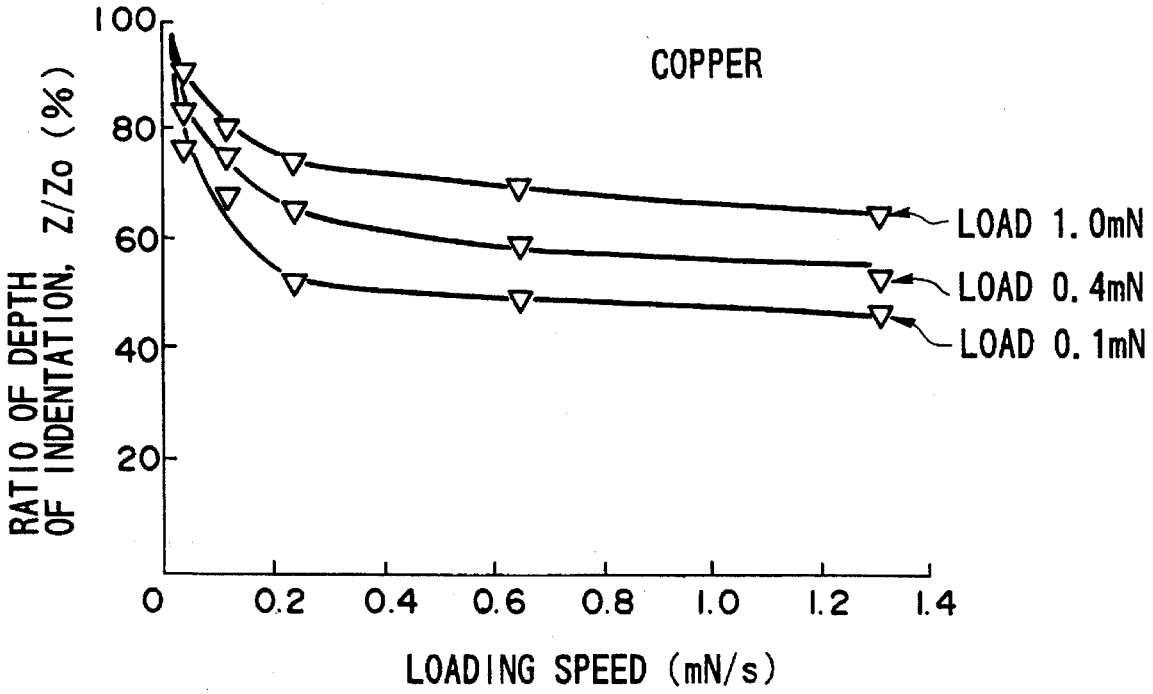
FIG. 6 is a characteristic diagram showing the results of indentation of an indenter into copper.
Figure 7:
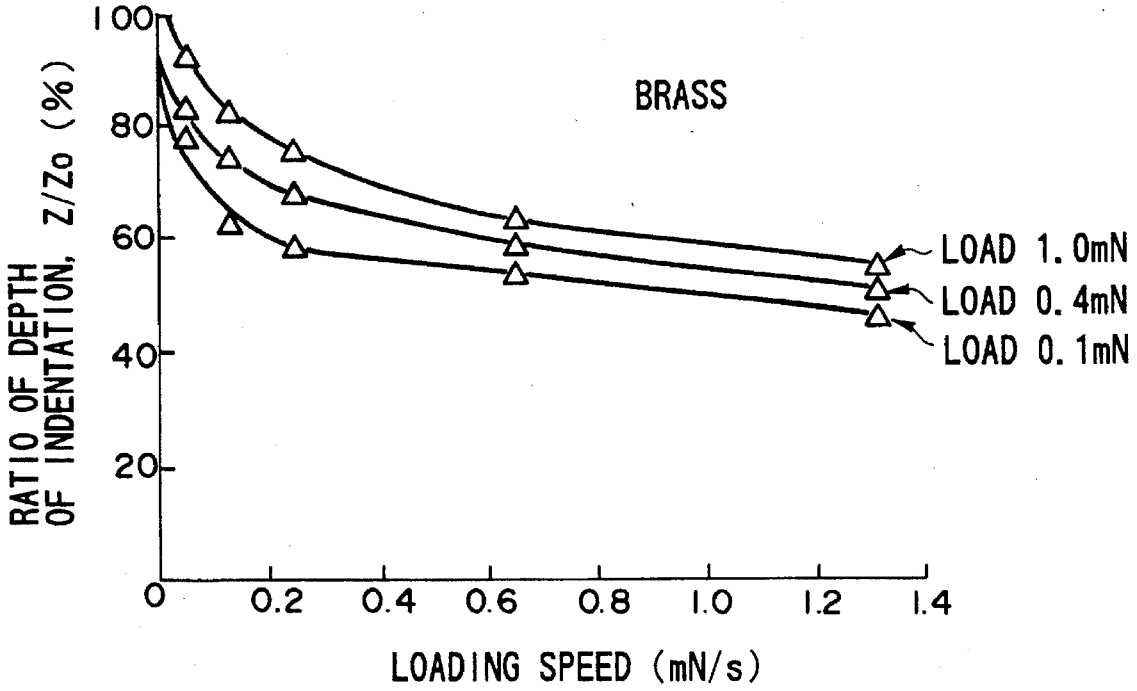
FIG. 7 is a characteristic diagram showing the results of indentation of an indenter into brass.

In order to examine said lap rigidity in supporting the abrasive grains, a test was conducted in which a diamond indenter was thrust into the lap material. The diamond indenter is here synonymous with the abrasive grains. The testing apparatus used is diagrammatically shown in FIG. 3. A load was applied to the indenter by a voice coil 32 and the amount of displacement of the indenter thrust into the lap was detected by a differential transformer 33. In the test, the indenter was indented into tin which has been generally used as lap material and into aluminum (JIS A 1050P), copper (JIS C 1020P) and brass (one in which the mass of copper contained is 50% or above) which are considered usable as lap material, to a depth of indentation ranging from 0.02 to 0.7 μm. The test results are shown in FIGS. 4 to 7. The depth of indentation effected when the indenter was thrust into the lap material at a very low loading speed (0.024 mN/s) was given as $Z_0$ and the ratio of the depth of indentation Z to $Z_0$ was plotted as ordinate. The depth of indentation lessens as the loading speed increases. This is a phenomenon known as straining rate dependency of plastic deformation. It is also seen that the amount of decrease of the depth of indentation varies according to the load.

The test results show that under the head lapping conditions (loading speed per abrasive grain is about 1.3 mN/s and load is around 0.1 mN when lapping speed is about 0.5 m/s and average lapping pressure is 0.8 $mN/mm^2$), tin is large in change of amount of indentation relative to change of load, that is, tin is small in rigidity in supporting abrasive grains and tends to produce a pole recession. On the other hand, aluminum, copper and brass are smaller in change of amount of indentation relative to change of load, that is, higher in rigidity in supporting abrasive grains and less prone to generation of pole recession than tin.

Figure 8:
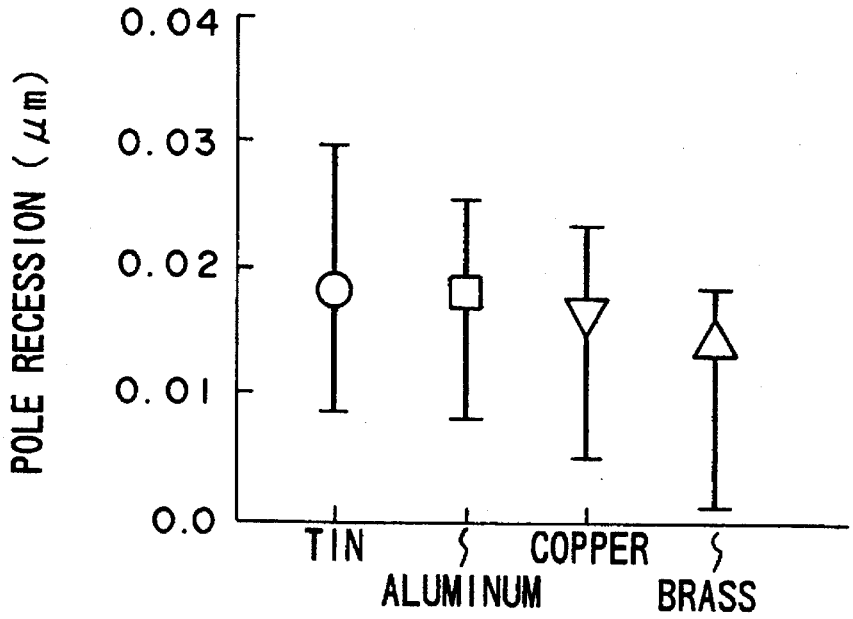
FIG. 8 is a graph showing the pole recessions in the magnetic heads lapped by using various types of lap.

FIG. 8 shows the ranges of pole recession generated when lapping was carried out by using the laps made of said materials. Diamond abrasive grains having an average grain size of 0.25 μm were used for lapping which was conducted at a lapping speed of 0.5 m/s under an average lapping pressure of 0.8 $mN/mm^2$. It is seen that when lapping is carried out by using a lap made of aluminum, copper or brass, the pole recession is less than when lapping is performed with a tin lap. Smaller pole recession enables shortening of bit length of magnetic disc and corresponding increase of recording density.

Figure 9:
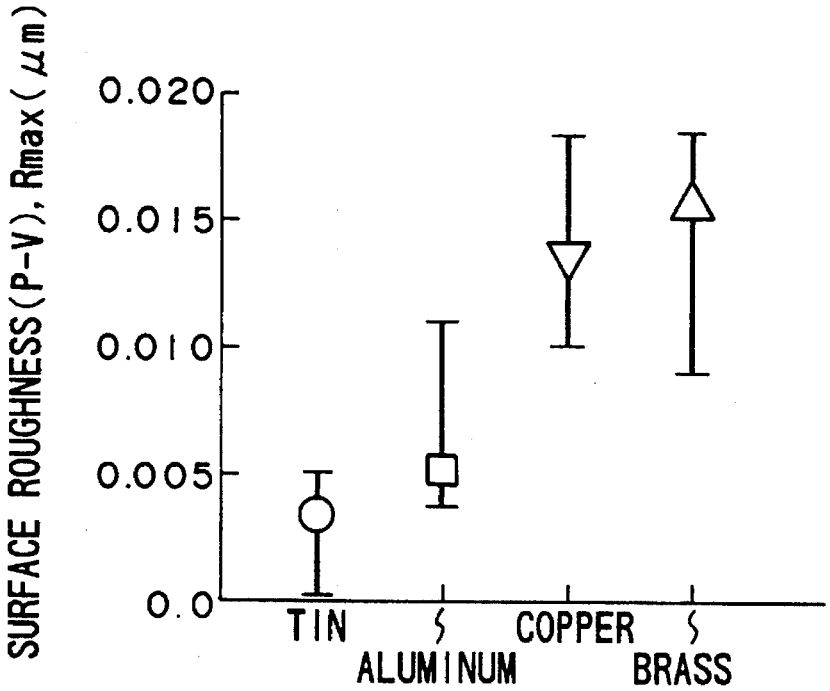
FIG. 9 is a graph showing the surface roughness (P-V) of the air-bearing surface of each of the magnetic heads lapped with various types of lap.

However, Vickers hardness (Hv) of aluminum is about 50 while that of copper and brass is about 100, and thus these materials are harder than tin (Hv=15). Therefore, when using a lap made of aluminum, copper or brass, if there exist the grains with extraordinarily large sizes in the abrasive grains used, scratches are formed on the lapped surface by these large-sized abrasive grains, increasing the surface roughness of the lapped article. The results of measurement of surface roughness of the air-bearing surfaces of magnetic head lapped under said conditions are,shown in FIG. 9. It is seen that a greater degree of surface roughness is provided by lapping with aluminum, copper or brass than by lapping with tin. This is due to the presence of the grains with extraordinarily large sizes, 2 μm at largest, in the standard abrasive grains whose average size is 0.25 μm.

High roughness of the air-bearing surface instabilizes the flying characteristics of magnetic head, which hinders improvement of recording density.

From the foregoing, it can be concluded that by carrying out lapping with a material having both a portion with low hardness like tin and the portion with higher hardness and greater rigidity in supporting the abrasive grains than tin (the portion comprising copper or brass in this example), it should be possible to obtain an air-bearing surface which is smaller in roughness than when lapping is performed by using a lap made of aluminum, copper or brass alone and which is also less in pole recession than when conducting lapping with a lap made of tin alone.

Therefore, in this example of the invention, the air-bearing surface of a magnetic head was lapped by using two types of lap described below.

Figure 10:
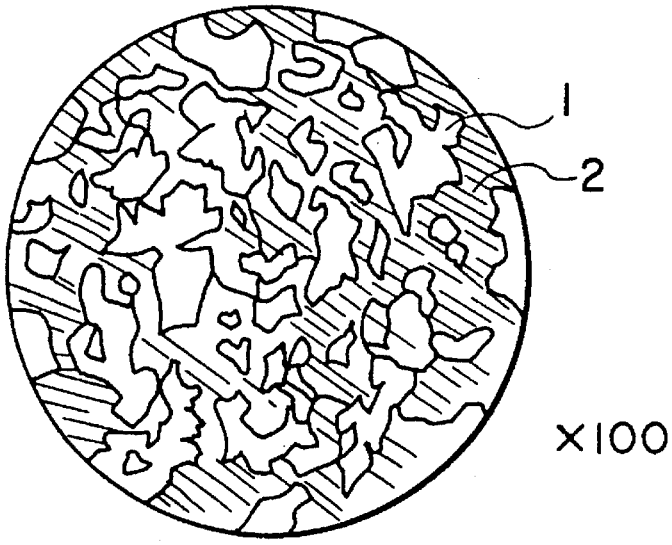
FIG. 10 is a schematic drawing showing the texture of a copper-brass sintered alloy in an embodiment of the present invention.

One of them was a lap obtained by uniformly mixing powder of tin and powder of brass (mass of copper contained therein being 50% or above) at a tin: brass ratio of from 30: 70 to 80: 20 in mass % and sintering the mixture at a temperature close to the melting point of tin (180°–210° C.) under pressure. FIG. 10 shows the texture of this lap as observed under a microscope. In this sintered body of a mixed material of tin powder and brass powder, Hv=20 in the tin phase 2 and Hv≦200 in the brass phase 1.

Figure 11:
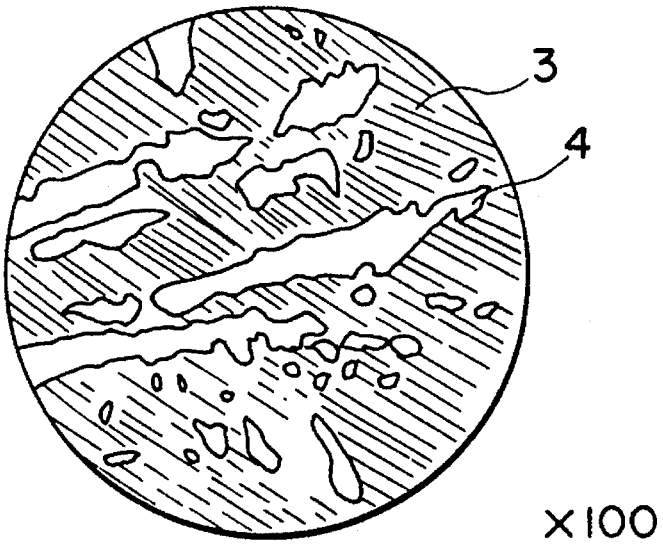
FIG. 11 is a schematic drawing showing the texture of a tin-copper cast alloy in another embodiment of the present invention.

Another one was a casting obtained by mixing molten copper in molten tin at a copper to tin ratio of 0.7–7.6 in mass % in an environment of 450°–500° C. and then cooling the mixture. FIG. 11 shows the texture of this casting as observed under a microscope. Hv=20 in the tin phase 3 and Hv=200 in the copper/tin compound phase 4.

Figure 12:
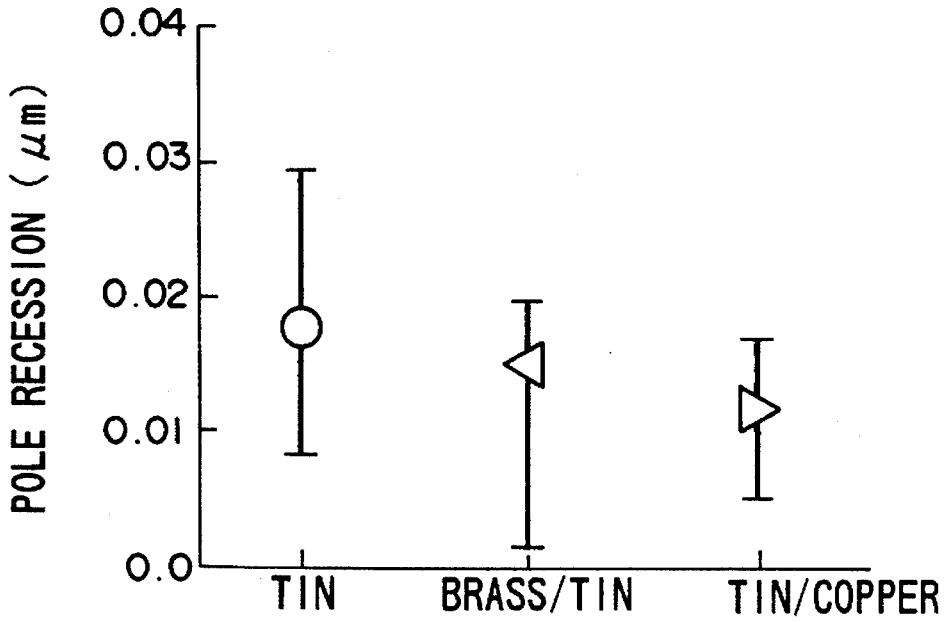
FIG. 12 is a graph showing the pole recessions in the magnetic heads lapped by using the multiphase alloy laps according to said embodiments of the present invention.
Figure 13:
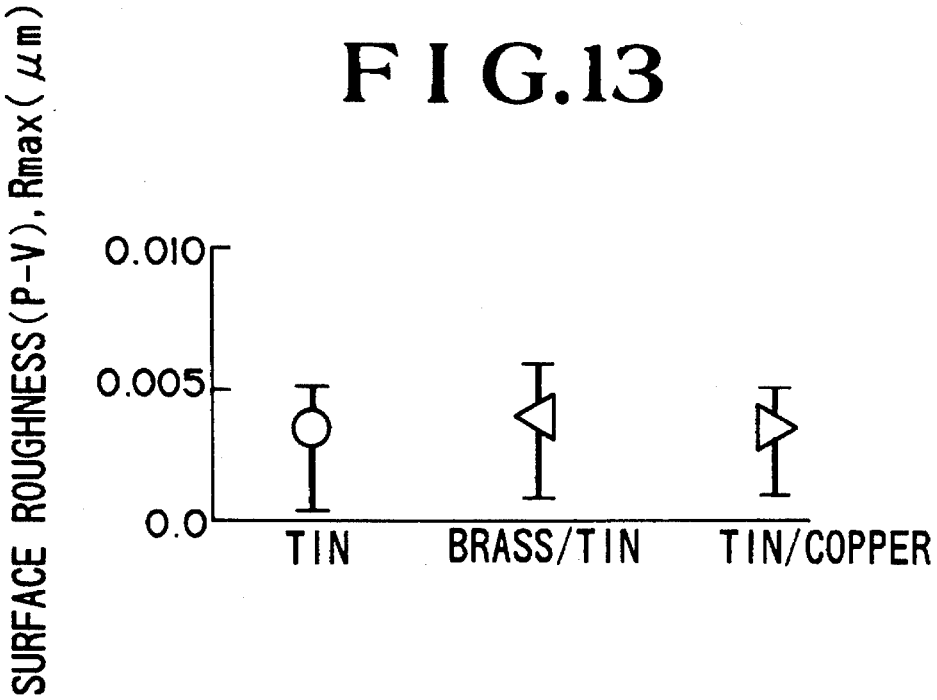
FIG. 13 is a graph showing the surface roughness (P-V)

FIG. 12 and FIG. 13 show the pole recession and the maximum height (Rmax) of the air-bearing surface of a magnetic head after lapping of the air-bearing surface of the magnetic head with the laps using said materials. It is noted from these figures that by lapping the air-bearing surface of a magnetic head by using a sintered mixture of tin powder and brass powder or a casting of tin and copper as the lap, it is possible to obtain an air-bearing surface of a magnetic head which is smaller in pole recession than when lapping is conducted with a conventional tin lap and which has a surface roughness equal to that provided by lapping with a conventional tin lap.

Reduction of pole recession can be accomplished not only by the above-described techniques but also by a method in which the difference between the material constants $\alpha_1$ and $\alpha_2$ of the different types of material is lessened. A method for lessening the difference between $\alpha_1$ and $\alpha_2$ by the action of a lapping liquor is described below.

Usually, the surfaces of metals, oxides and ionic crystal materials are electrically charged in an aqueous solution, but alumina ($Al_2O_3$) keeps its surface free of electric charges in a weakly alkaline aqueous solution with a pH close to 9, but its surface is positively charged on the acidic side of said pH value (9) and negatively charged on the alkaline side.

Figure 1:
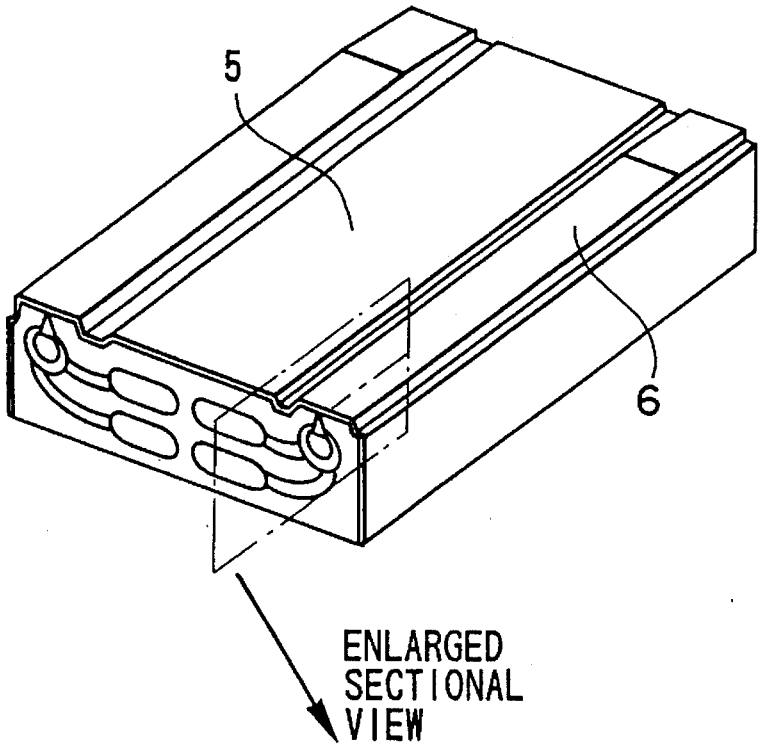
FIG. 1 is the schematic illustrations intended to show principally a thin-film magnetic head and the pole recession.
Figure 1:
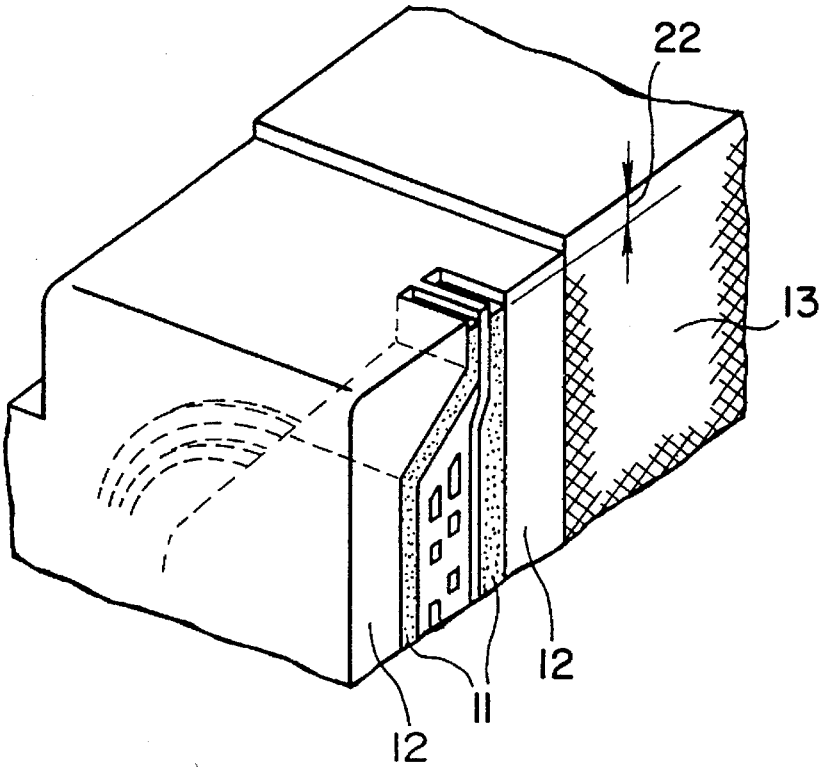
Figure 2:
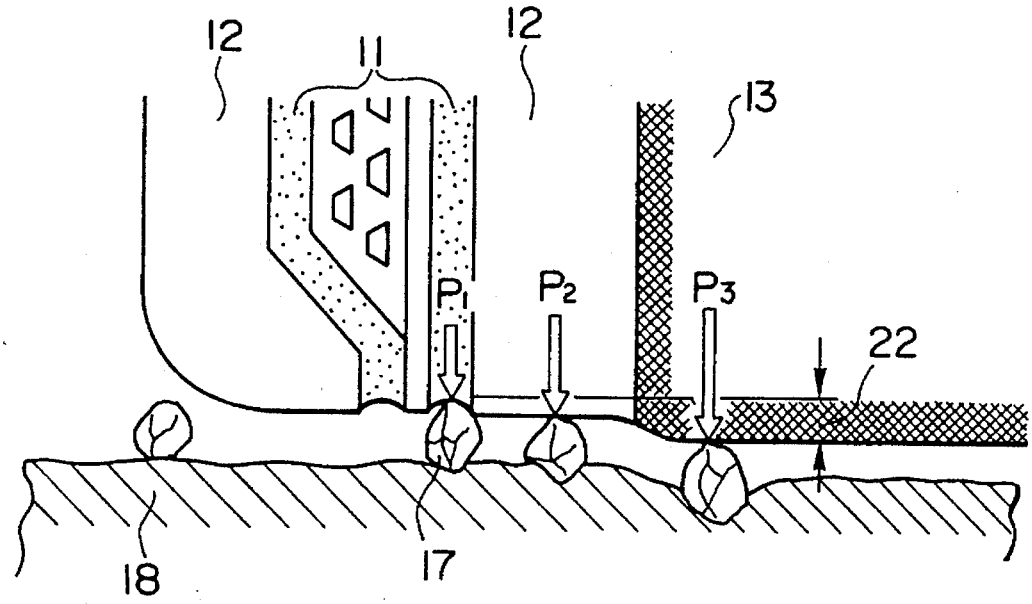
FIG. 2 is a schematic illustration showing the mechanism of generation of pole recession.

Regarding the materials composing the magnetic head shown in FIG. 1, usually the magnetic film 11 is metal and the protective film 12 is alumina. The substrate 13 is made of a ceramic material comprising the ionic crystals containing alumina partially or of other ceramic materials.

In a magnetic head composed of these materials, when its air-bearing surface is lapped with a lapping liquor of a pH of 9 or below, the surfaces of the magnetic film 11 and the substrate 13 are negatively charged while the protective film 12 is positively charged.

For dispersing the non-polar diamond abrasive grains in a water-soluble lapping liquor, it has been generally practiced to dissolve a sulfate of a naphthalene condensate, i.e. an anionic surfactant, in the liquor as a dispersant. It is known, however, that when lapping is conducted by using this lapping liquor, the anions of the anionic surfactant and the positive charges on the surface of the protective film 12 are attracted to each other, and the anionic surfactant remaining in the lapping liquor without taking part in dispersion of the abrasive grains is adsorbed on the surface of the protective film 12 alone as shown in FIG. 14.

The present inventors have made researches on possible influences of this adsorption film from various aspects and found that the presence of .such an adsorption film is detrimental to lapping work. That is, the abrasive grains become less liable to get caught on the protective film 12 because of the presence of the adsorption film of the anionic surfactant, thus retarding lapping work on the protective film. No such phenomenon occurs on the magnetic film 11 and the substrate 13 where no adsorption film exists. Accordingly, the level difference 24 between protective film 12 and substrate 13 is small (this level difference being hereinafter referred to as "recession of the protective film portion"), while the level difference 23 between magnetic film 11 and protective film 12 is enlarged (this level difference being hereinafter referred to as "recession of the magnetic film portion").

By contrast, when a cationic surfactant is used as dispersant for the abrasive grains, an adsorption film of the cationic surfactant is formed on the surfaces of the magnetic film 11 and the substrate 13 while no such adsorption film is formed on the protective film 12. Consequently, the level difference 23 between magnetic film 11 and protective film 12 is small while the level difference 24 between protective film 12 and substrate 13 is enlarged.

FIG. 16 is a graphic representation of the results of lapping carried out with the lapping liquors using said dispersants. The pole recession shown in the figure corresponds to the sum of the recession of the protective film portion 24 and the recession of the magnetic film portion 23. Lapping was conducted by using a tin-made lap at a lapping speed of 0.5 m/s under an average lapping pressure of 0.8 $mN/mm^2$. The lapping liquor using an anionic surfactant was prepared by dispersing 0.6 g of diamond abrasive grains having an average grain size of 0.25 μm in 500 ml of a 1.0 wt % aqueous solution of sodiumalkyldiphenyl disulfonate which is an anionic surfactant. The lapping liquor using a cationic surfactant was prepared by dispersing 0.6 g of diamond abrasive grains having an average grain size of 0.25 μm in 500 ml of a 1.0 wt % aqueous solution of alkyltrimethylammonium chloride which is a cationic surfactant.

In view of the above results, the present inventors conceived that if an adsorption film was formed on any of the magnetic film 11, protective film 12 and substrate 13, the difference between the material constants $\alpha_1$ and $\alpha_2$ would be reduced and consequently the pole recession would be lessened. This conception has led to the invention of a lapping liquor which is described in detail below.

Among the surfactants, there are the ampholytic surfactants which have both an electrically positively biased portion and a negatively biased portion in the molecule. By using such an ampholytic surfactant, it is possible to make an adsorption film on all of the magnetic film 11, protective film 12 and substrate 13. However, ampholytic surfactants are inferior to anionic surfactants in abrasive grains dispersing force because of smaller absolute value of electrical charge than anionic surfactants.

It is impossible to form an adsorption film with an anionic surfactant on the protective film 12 while forming at the same time an adsorption film with a cationic surfactant on the magnetic film 11 and substrate 13. This is because the anions of the anionic surfactant and the cations of the cationic surfactant are chemically reacted to form a precipitate, and consequently both surfactants are deprived of their dispersing force.

In the present example of the invention, therefore, the abrasive grains were dispersed in an aqueous mixture of an anionic surfactant and an ampholytic surfactant which were mixed in pure water, and this dispersion was used as lapping liquor. An anionic surfactant and an ampholytic surfactant do not reacted and precipitated even if mixed with each other.

When this lapping liquor is used, the anionic portion of the anionic surfactant and the negatively charged portion of the ampholytic surfactant are adsorbed on the positively charged surface of the protective film 12 as shown in FIG. 17. At the same time, the positively charged portion of the ampholytic surfactant is adsorbed on the negatively charged surfaces of magnetic film 11 and substrate 13. The result of lapping carried out by using this lapping liquor is shown in FIG. 16. This lapping liquor, to be more specific, was prepared by dispersing 0.6 g of diamond abrasive grains having an average grain size of 0.25 μm in 500 ml of an aqueous solution comprising a mixture of 250 ml of a 0.5 wt % aqueous solution of sodiumalkyldiphenyl ether disulfonate (an anionic surfactant) and 250 ml of a 0.5 wt % aqueous solution of alkyldimethylbetaine (an ampholytic surfactant). Other conditions were the same as with the previously described conventional lapping liquors.

As seen from FIG. 16, when lapping was carried out by using the lapping liquor prepared by mixing an anionic surfactant and an ampholytic surfactant, the pole recession of the magnetic head could be notably lessened as compared with lapping with a conventional lapping liquor prepared by using an anionic surfactant alone.

FIGS. 18 to 20 show the results of investigation of the influence of concentrations of anionic surfactant and ampholytic surfactant on pole recession. The pole recession was enlarged as the content of the anionic surfactant was increased. This is because increase of the anionic surfactant facilitates formation of an adsorption film on the surface of the protective film 12 alone, resulting in impeded lapping of this protective film. Conversely, the pole recession was diminished as the content of the ampholytic surfactant was increased. This is attributed to encouraged formation of an adsorption film on the surfaces of all of the magnetic film 11, protective film 12 and substrate 13.

Especially when using a lapping liquor prepared by dispersing 0.6 g of diamond abrasive grains having an average grain size of 0.25 μm in 500 ml of an aqueous solution having dissolved therein an anionic surfactant in a mass of 0.6% or less and an ampholytic surfactant in a content of 0.4% or above, it was possible to confine the pole recession 22 to less than 0.02 μm even when lapping was performed with a conventionally used tin-made lap. The lapping conditions in this case were the same as those under which the results shown in FIG. 16 were obtained.

Further, when lapping was carried out with a tin/brass or tin/copper lap such as mentioned above by using the lapping liquor according to the instant embodiment of the present invention, the pole recession was even more reduced, down to less than 0.01 μm, owing to the synergistic effect of said lapping liquor and said lap as shown in FIGS. 21 and 22.

In the above embodiment of the present invention, there was described a case of lapping of the air-bearing surface of a magnetic head, but the present invention can be applied to lapping of not only the magnetic heads but also all types of articles comprising a composite material having the portions differing in hardness or having a portion positively charged on the surface and a portion negatively charged on the surface when placed in an aqueous solution, and is capable of minimizing the pole recession of the lapped articles.

Now, a lapping apparatus using the lap and the lapping liquor explained in the above embodiment of the invention is described with reference to FIG. 23.

This lapping apparatus comprises a lap 60 and a drive unit (not shown) for rotating said lap. There are provided a pump 70, a tube 71 and a tank 72 for supplying the lapping liquor onto the lap during the lapping work. A jig 62 is used for holding the workpiece in position, and a correcting ring 64 is provided for preventing nonuniform defacement of the lap 60.

Said lap 60, at least its lapping surface, is made of the material described above, namely a sintered material composed of tin powder and brass powder or a casting of tin and copper. However, the lap may be made of other materials which meet the specified conditions relating to hardness and rigidity in supporting the abrasive grains.

As for the lapping liquor, it is preferable to use the one described in the above embodiment of the invention, but it is of course possible to use other lapping liquors of pertinent compositions.

The workpiece is held by the jig 62 and placed on the lap 60. In this state, the working liquor, i.e. the lapping liquor stored in the tank 72 is supplied onto the lap 60. As the lap 60 is rotated by said drive unit, the abrasive grains contained in the supplied lapping liquor get in between the lap 60 and the workpiece to polish the latter.

The above-described lapping apparatus is but a mere example, and it is possible to employ the apparatus of other suitable mechanisms.

A magnetic recording device using a magnetic head lapped by using said lapping apparatus is described below with reference to FIG. 24.

This magnetic recording device comprises a magnetic disc 81 housed rotatably in a casing 80 and a spindle motor 82 adapted for rotating said magnetic disc. The magnetic head 84 for reading the information recorded on the magnetic disc 81 is held by a swing arm 85, a steel band 86, etc. It is designed to be movable along the information recorded surface of said magnetic disc 81 by a stepper motor 83. These elements are controlled in motion by a control circuit not shown. The magnetic head 84 used in this recording device has been lapped by using the lapping apparatus described above, and the pole recession in its air-bearing surface is very small. Therefore, there is little possibility that the flying height of the magnetic head become substantially greater than the pole recession, and it is thus possible to make recording of higher density than possible with the conventional magnetic heads.

In the magnetic recording device shown and described here, the magnetic disc 81 is fixed and unexchangeable, but arrangement may be made so that the magnetic disc 81 can be exchanged as desired by the user. It is also possible to employ other mechanisms than the one shown in FIG. 24.

When lapping is performed with a lapping apparatus using the .lap of the present invention, the generation of pole recession is suppressed even if the workpiece has the portions differing in hardness. For example, when the air-bearing surface of a thin-film magnetic head is lapped by this lapping apparatus, the pole recession whose minimal value achievable with the prior art has been 0.03 μm can be reduced to 0.02 μm or less, and this enables reduction of the current minimal recording bit length of magnetic disc by at least 0.05 μm.

It is possible to further reduce the pole recession by the combined use of the lap and the lapping liquor of the present invention.

Also, by using a magnetic head which has been lapped by using the lapping apparatus and the lapping liquor according to the present invention and which is therefore small in pole recession, it is possible to obtain a magnetic recording device capable of high-density recording.

What is claimed is:

1. A lap, used for lapping a workpiece by moving the workpiece slidingly relative to the lap with free abrasive diamond grains present on the lap, at least a surface of the lap comprising a material which comprises a phase of brass in which the mass of copper contained therein is 50% or above and a phase of tin.

2. A lap according to claim 1, wherein said free abrasive diamond grains have an average size of 0.25 μm.

3. A lap according to claim 1, wherein a ratio of tin:brass is 30:70 to 80:20.

4. A lap used for lapping a workpiece by moving the workpiece slidingly relative to the lap with free abrasive diamond grains present on the lap, at least a surface of the lap comprising a casting obtained by mixing molten tin and molten copper whose ratio to tin in mass % is 0.7–7.6, and cooling the mixed melt.

5. A lap according to claim 4, wherein said free abrasive diamond grains have an average size of 0.25 μm.

6. A lapping liquor comprising an aqueous solution containing an anionic surfactant and an ampholytic surfactant and diamond abrasive grains dispersed in said aqueous solution, wherein the ratio by mass of said anionic surfactant in said aqueous solution of 0.6 wt. % or less and the ratio of said ampholytic surfactant in said aqueous solution is 0.4 wt. % or above.

7. A lap according to claim 6, wherein said free abrasive diamond grains have an average size of 0.25 μm.

* * * * *